US009624581B2

(12) United States Patent
Yamakawa et al.

(10) Patent No.: US 9,624,581 B2
(45) Date of Patent: Apr. 18, 2017

(54) COMPOSITION FOR PRODUCTION OF METAL FILM, METHOD FOR PRODUCING METAL FILM AND METHOD FOR PRODUCING METAL POWDER

(75) Inventors: Tetsu Yamakawa, Kanagawa (JP); Noriaki Oshima, Kanagawa (JP); Takahiro Kawabata, Kanagawa (JP); Tomoyuki Kinoshita, Kanagawa (JP); Toshio Inase, Kanagawa (JP)

(73) Assignees: TOSOH CORPORATION, Yamaguchi (JP); SAGAMI CHEMICAL RESEARCH INSTITUTE, Kanagawa (JP)

( * ) Notice: Subject to any disclaimer, the term of this patent is extended or adjusted under 35 U.S.C. 154(b) by 0 days.

(21) Appl. No.: 13/121,005

(22) PCT Filed: Oct. 21, 2009

(86) PCT No.: PCT/JP2009/068136

§ 371 (c)(1),
(2), (4) Date: Mar. 25, 2011

(87) PCT Pub. No.: WO2010/047350

PCT Pub. Date: Apr. 29, 2010

(65) Prior Publication Data

US 2011/0183068 A1 Jul. 28, 2011

(30) Foreign Application Priority Data

Oct. 22, 2008 (JP) ..... 2008-272024
Oct. 22, 2008 (JP) ..... 2008-272025
Oct. 22, 2008 (JP) ..... 2008-272026

(51) Int. Cl.
*H01B 1/02* (2006.01)
*C23C 18/08* (2006.01)
*B22F 9/24* (2006.01)

(52) U.S. Cl.
CPC ..... *C23C 18/08* (2013.01); *B22F 9/24* (2013.01); *B22F 2998/00* (2013.01); *H01B 1/02* (2013.01); *H01B 1/026* (2013.01)

(58) Field of Classification Search
CPC ..... H01B 1/02
(Continued)

(56) References Cited

U.S. PATENT DOCUMENTS 3,451,813 A * 6/1969 Kinney et al. ..... 430/319
4,539,041 A * 9/1985 Figlarz et al. ..... 420/435
(Continued)

FOREIGN PATENT DOCUMENTS

EP 0469470 A1 * 2/1992
JP 59-173206 A 10/1984
(Continued)

OTHER PUBLICATIONS

Yukio Kobayashi, "Electroconductive Nano Filler and Applied Products", CMC Publishing Ltd.—http://www.cmcbooks.co.jp/ High Technology Information , 2005, pp. 99-110.
(Continued)

*Primary Examiner* — William Young
(74) *Attorney, Agent, or Firm* — Greenblum & Bernstein, P.L.C.

(57) ABSTRACT

A composition that includes a high-valent compound of copper, silver or indium; a linear, branched or cyclic $C_{1-18}$ alcohol; and a Group VIII metal catalyst forms a metal film of copper, silver or indium on a substrate when the composition is coated on the substrate and heated to reduce the high-valent compound. The composition may alternatively include metal particles of silver, copper or indium in which the surface layer of the particle includes a high-valent compound of copper, silver or indium. A metal film of copper, silver or indium may also be formed on a substrate
(Continued)

by coating a substrate with the composition including the metal particles, and heating to reduce the high-valent compound in the same manner as above.

1 Claim, 6 Drawing Sheets

(58) Field of Classification Search
USPC ..... 252/514, 519.3, 500, 512
See application file for complete search history.

(56) References Cited

U.S. PATENT DOCUMENTS

| | | | | |
|---|---|---|---|---|
| 5,759,230 | A * | 6/1998 | Chow et al. | 75/362 |
| 6,197,366 | B1 * | 3/2001 | Takamatsu | 427/125 |
| 6,679,937 | B1 * | 1/2004 | Kodas et al. | 75/365 |
| 2003/0148024 | A1 | 8/2003 | Kodas et al. | |
| 2004/0038529 | A1 * | 2/2004 | Soininen et al. | 438/685 |
| 2004/0043153 | A1 | 3/2004 | Okuhama et al. | |
| 2004/0167257 | A1 * | 8/2004 | Ryang | 524/262 |
| 2004/0259007 | A1 | 12/2004 | Takahashi et al. | |
| 2005/0074589 | A1 * | 4/2005 | Pan et al. | 428/206 |
| 2005/0116203 | A1 | 6/2005 | Takahashi et al. | |
| 2006/0210705 | A1 * | 9/2006 | Itoh et al. | 427/96.1 |
| 2006/0223312 | A1 * | 10/2006 | Yonker et al. | 438/674 |
| 2007/0180954 | A1 * | 8/2007 | Kim | B22F 1/0018 75/373 |
| 2007/0190248 | A1 * | 8/2007 | Elers et al. | 427/248.1 |
| 2007/0290175 | A1 * | 12/2007 | Kim | 252/500 |
| 2008/0131359 | A1 * | 6/2008 | Behrens et al. | 423/648.1 |

FOREIGN PATENT DOCUMENTS

| | | | |
|---|---|---|---|
| JP | 2006257484 | | 9/2006 |
| JP | 2008-24968 | A | 2/2008 |
| WO | 03/056574 | A1 | 7/2003 |
| WO | 03/085052 | A1 | 10/2003 |

OTHER PUBLICATIONS

"Heisei 20 Nendo Ippan Nenji Hokoku", Sagami Chemical Research Center, vol. 4, (2009)., 2009, pp. 15-16.

International Preliminary Report on Patentability, mail date May 26, 2011.

Extended European Search Report in respect to European Application No. 09822047.8, dated Oct. 21, 2016.

* cited by examiner

A: XRD peak of copper

B: XRD peak of copper(II) oxide

C: XRD peak of copper(I) oxide

A: After heating

B: Before heating

COMPOSITION FOR PRODUCTION OF METAL FILM, METHOD FOR PRODUCING METAL FILM AND METHOD FOR PRODUCING METAL POWDER

TECHNICAL FIELD

The present invention relates to a composition for production of a metal film of copper, silver or indium, a method for producing a metal film, and a method for producing a metal powder.

BACKGROUND ART

Along with an increase in the size of a flat panel display (FPD), a flexible display represented by electronic paper has attracted attention. For such a device, various metal films are used for the wiring and electrodes. As a method of forming a metal film, a vacuum film deposition method such as sputtering and vacuum deposition has been widely used, and various circuit patterns and electrodes are formed by photolithography using a photomask.

In recent years, as a wiring/electrode film formation method which is capable of the reduction of the processes required for the pattern formation and is suitable for the mass production and the cost reduction, film formation employing screen printing or an ink jet method has been actively studied. This method forms wiring/electrode film by calcination of conductive fine particles and the like after mixing them with an organic binder, an organic solvent or the like into a paste or an ink and forming the pattern on a substrate directly from the resulting mixture using screen printing or ink jet methods. This method is characteristic not only on the point of the mass and low-cost production being possible due to simpler process than the conventional photolithography, but also on the point of low environmental load because the treatment of the waste and the like in the process of etching is unnecessary. Further, as a low temperature process is possible, this method attracts attention also as a method of forming a film for a flexible display using a plastic or sheet-form substrate.

For production of a metal film by a coating method, the method commonly employed is the method of applying a coating agent obtained by kneading a metal powder with e.g. a paste, on a substrate e.g. by printing, followed by heat treatment. The coating agent used in this method is commonly prepared by taking a preliminarily produced metal powder with high polymer protective colloid etc. and mixing it with a resin etc. (for example, Non-Patent Document 1).

As compared with this method, from the viewpoint of energy saving and simplification of the production process for production of a display panel and various devices, a composition to directly form a metal film from a high-valent metal compound has been desired.

Further, the method for producing a metal powder used for the production of a metal film is roughly classified into a vapor phase method and a liquid phase method.

The vapor phase method is a method of evaporating a metal in a pure inert gas. It is possible to produce a metal powder with little impurities by this method. However, this method requires a large and special apparatus, and accordingly the production cost is high, and the mass production is hardly carried out.

The liquid phase method is a method of reducing a high-valent metal compound in a liquid phase by using ultrasonic waves, ultraviolet rays or a reducing agent. This method is advantageous in that the mass production is easy.

As the reducing agent, hydrogen, diborane, an alkali metal borohydride, a quaternary ammonium borohydride, hydrazine, citric acid, an alcohol, ascorbic acid, an amine compound or the like is used (for example, Non-Patent Document 1).

Further, a method has been disclosed to produce a metal powder from an oxide of e.g. nickel, lead, cobalt or copper by using a polyol as a reducing agent (for example, Patent Document 1). However, this method requires a high temperature of at least 200° C. and a reaction time of at least 1 hour. In future, reduction of the total energy for production of various display panels and devices will be essential, and the energy reduction for production of constituting materials to be used is also absolutely necessary. Accordingly, powder production conditions at lower temperature in shorter time, which makes a low temperature process and a short time process possible, have been required.

PRIOR ART DOCUMENTS

Patent Document

Patent Document 1: JP-A-59-173206

Non-Patent Document

Non-Patent Document 1: "Electroconductive Nano Filler and Applied Products" published by CMC Publishing Co., Ltd., 2005, pages 99 to 110

DISCLOSURE OF INVENTION

Technical Problem

It is an object of the present invention to provide a composition for production of a metal film, a method for producing a metal film and a method for producing a metal powder, which make it possible to reduce the production energy of constituting materials so as to make it possible to reduce the total energy in production of various display panels and in production of devices.

Solution to Problem

The present inventors have conducted extensive studies to accomplish the above object and as a result, accomplished the present invention.

That is, the present invention provides a composition for production of a metal film of copper, silver or indium, which comprises a high-valent compound of copper, silver or indium, a linear, branched or cyclic $C_{1-18}$ alcohol and a Group VIII metal catalyst.

The present invention further provides a method for producing a metal film of copper, silver or indium, which comprises forming a coating film by using the composition for production of a metal film, followed by reduction by heating.

The present invention further provides a method for producing a metal powder of copper, silver or indium, which comprises subjecting a high-valent compound of copper, silver or indium to reduction by heating in the presence of a linear, branched or cyclic $C_{1-18}$ alcohol and a Group VIII metal catalyst.

The present invention further provides a composition for production of a metal film of copper, silver or indium, which comprises metal particles of copper, silver or indium having a surface layer comprising a high-valent compound of copper, silver or indium, a linear, branched or cyclic $C_{1-18}$ alcohol and a Group VIII metal catalyst.

The present invention still further provides a method for producing a metal film of copper, silver or indium, which comprises forming a coating film by using the composition for production of a metal film, followed by reduction by heating.

Advantageous Effects of Invention

According to the present invention, a metal film of copper, silver or indium can be produced more economically and efficiently. The obtainable metal film of copper, silver or indium can be used for e.g. a conductive film and a conductive pattern film.

Further, according to the present invention, a metal powder of copper, silver or indium can be produced more economically and efficiently. The obtainable metal powder of copper, silver or indium can be used as a material of e.g. a conductive film, a conductive pattern film and a conductive adhesive.

DESCRIPTION OF EMBODIMENTS

Figure 1:
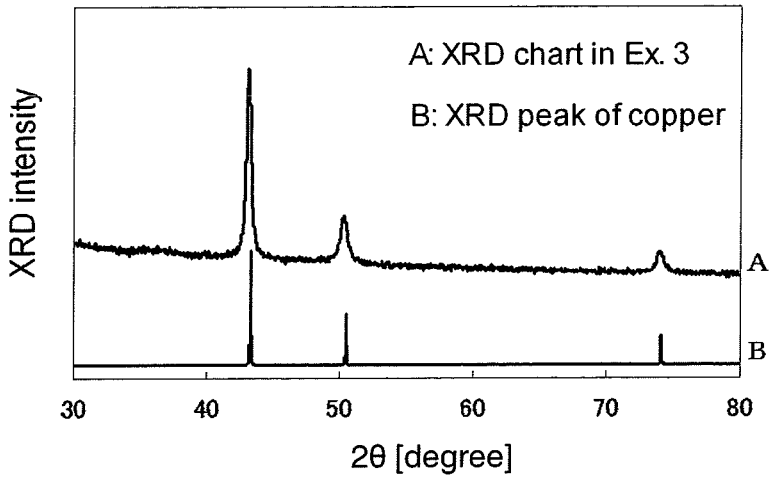
FIG. 1 is a diagram illustrating an X-ray diffraction pattern of a film after heating in Example 3.

Now, the present invention will be described in detail.

The high-valent compound used in the present invention is a compound in which the formal oxidation number of the metal is from I to III.

The high-valent compound of copper, silver or indium may, for example, be specifically an oxide, a nitride, a carbonate, a hydroxide or a nitrate. In view of the good reaction efficiency, an oxide, a nitride or a carbonate is preferred, and copper(I) oxide, copper(II) oxide, copper(I) nitride, silver(I) oxide, silver(I) carbonate or indium(III) oxide is more preferred.

The state of the high-valent compound is not particularly limited, however, particles are preferred with a view to obtaining a highly dense metal film. The average particle size is preferably from 5 nm to 500 μm, more preferably from 10 nm to 100 μm.

In the present invention, the average particle size is a volume particle size at the cumulative 50% in the particle size distribution measured by a dynamic light scattering method at from 5 nm to 1 μm and by a laser diffraction/scattering method at from 1 μm to 500 μm.

Further, among the metal particles of copper, silver or indium having a surface layer comprising a high-valent compound of copper, silver or indium, to be used in the present invention, the average particle size is preferably from 5 nm to 500 μm, more preferably from 10 nm to 100 μm including the surface layer. The average particle size in this case is also as defined above.

The "surface layer" of the metal particles of copper, silver or indium having a surface layer comprising the high-valent compound means a region from the outermost surface of the particle to a part where the composition becomes the metal. This region comprises the high-valent compound, and can consist substantially solely of the high-valent compound, can be a mixture of the high-valent compound with the metal, or can be such a mixture that the high-valent compound in the mixture has a concentration gradient depending on the region and its concentration varies. The thickness of the surface layer is not particularly limited and is preferably from about 5 to about 50 nm, although it depends on the balance with the size of the particles.

The metal particles of copper, silver or indium having the surface layer comprising the high-valent compound can be produced by a thermal plasma method, or can be commercially available.

In the present invention, it is essential to use a linear, branched or cyclic $C_{1-18}$ alcohol. Specific examples of an alcohol include a monol such as methanol, ethanol, propanol, 2-propanol, allyl alcohol, butanol, 2-butanol, pentanol, 2-pentanol, 3-pentanol, cyclopentanol, hexanol, 2-hexanol, 3-hexanol, cyclohexanol, heptanol, 2-heptanol, 3-heptanol, 4-heptanol, cycloheptanol, octanol, 2-octanol, 3-octanol, 4-octanol, cyclooctanol, nonanol, 2-nonanol, 3,5,5-trimethyl-1-hexanol, 3-methyl-3-octanol, 3-ethyl-2,2-dimethyl-3-pentanol, 2,6-dimethyl-4-heptanol, decanol, 2-decanol, 3,7-dimethyl-1-octanol, 3,7-dimethyl-3-octanol, undecanol, dodecanol, 2-dodecanol, 2-butyl-1-octanol, tridecanol, tetradecanol, 2-tetradecanol, pentadecanol, hexadecanol, 2-hexadecanol, heptadecanol, octadecanol, 1-phenethyl alcohol and 2-phenethyl alcohol.

Further, specific examples of an alcohol include a diol such as ethylene glycol, 1,3-propanediol, 1,2-butanediol, 1,3-butanediol, 1,4-butanediol, 2,3-butanediol, 1,5-pentanediol, 1,2-hexanediol, 1,5-hexanediol, 1,6-hexanediol, 2,5-hexanediol, 1,7-heptanediol, 1,2-octanediol, 1,8-octanediol, 1,3-nonanediol, 1,9-nonanediol, 1,2-decanediol, 1,10-decanediol, 2,7-dimethyl-3,6-octanediol, 2,2-dibutyl-1,3-propanediol, 1,2-dodecanediol, 1,12-dodecanediol, 1,2-tetradecanediol, 1,14-tetradecanediol, 2,2,4-trimethyl-1,3-pentanediol, 2,4-pentanediol, 1,2-cyclohexanedimethanol, 1,3-cyclohexanedimethanol, 1-hydroxymethyl-2-(2-hydroxyethyl)cyclohexane, 1-hydroxy-2-(3-hydroxypropyl)cyclohexane, 1-hydroxy-2-(2-hydroxyethyl)cyclohexane, 1-hydroxymethyl-2-(2-hydroxyethyl)benzene, 1-hydroxymethyl-2-(3-hydroxypropyl)benzene, 1-hydroxy-2-(2-hydroxyethyl)benzene, 1,2-benzyldimethylol, 1,3-benzyldimethylol, 1,2-cyclohexanediol, 1,3-cyclohexanediol and 1,4-cyclohexanediol.

Further, specific examples of an alcohol include a triol such as glycerin, 1,2,6-hexanetriol and 3-methyl-1,3,5-pentanetriol, and a tetraol such as 1,3,5,7-cyclooctanetetraol.

Further, such alcohols can be mixed in an optional ratio.

In view of the good reaction efficiency, preferred is a linear, branched or cyclic $C_{2-12}$ alcohol, and more preferred is 1,3-butanediol, 2,4-pentanediol, 2-propanol, cyclohexanol, ethylene glycol, 1,3-propanediol, 1,4-cyclohexanediol or glycerin.

In the present invention, it is essential to use a Group VIII metal catalyst. As such a metal catalyst, a metal salt, a metal complex, a zero-valent metal catalyst, an oxide catalyst, a supported zero-valent metal catalyst, a supported hydroxide catalyst or the like can be used.

Specific examples of a metal salt include a halide salt such as ruthenium trichloride, ruthenium tribromide, rhodium trichloride, iridium trichloride, sodium hexachloroiridate, palladium dichloride, potassium tetrachloropalladate, platinum dichloride, potassium tetrachloroplatinate, nickel dichloride, iron trichloride and cobalt trichloride; an acetate such as ruthenium acetate, rhodium acetate and palladium acetate; a sulfate such as ferrous sulfate; a nitrate such as ruthenium nitrate, rhodium nitrate, cobalt nitrate and nickel nitrate; a carbonate such as cobalt carbonate and nickel carbonate; a hydroxide such as cobalt hydroxide and nickel hydroxide; and an acetylacetonato salt such as tris(acetylacetonato)ruthenium, bis(acetylacetonato)nickel and bis(acetylacetonato)palladium.

Specific examples of a metal complex include a phosphine complex such as dichlorotris(triphenylphosphine)ruthenium, trans-chlorocarbonylbis(triphenylphosphine)rhodium, tetrakis(triphenylphosphine)palladium, trans-chlorocarbonylbis(triphenylphosphine)iridium, tetrakis(triphenylphosphine)platinum, dichloro[bis(1,2-diphenylphosphino)ethane]nickel, dichloro[bis(1,2-diphenylphosphino)ethane]cobalt and dichloro[bis(1,2-diphenylphosphino)ethane]iron; a carbonyl complex such as triruthenium dodecacarbonyl, hexarhodium hexadecacarbonyl and tetrairidium dodecacarbonyl; and a hydrido complex such as dihydrido(dinitrogen)tris(triphenylphosphine)ruthenium, hydridotris(triisopropylphosphine)rhodium and pentahydridobis(triisopropylphosphine)iridium.

Further, they specifically include an olefin complex such as diethylene(acetylacetonato)rhodium; a diene complex such as dichloro(1,5-cyclooctadiene)ruthenium, acetonitrile(cyclooctadiene)rhodate, bis(1,5-cyclooctadiene)platinum and bis(1,5-cyclooctadiene)nickel; a π-allyl complex such as chloro(π-allyl)palladium dimer and chloro(π-allyl)tris(trimethylphosphine)ruthenium; and a trichlorostannate complex such as acetonitrilepentakis(trichlorostannato)ruthenate, chloropentakis(trichlorostannato)rhodate, cis,trans-dichlorotetrakis(trichlorostannato)iridate, pentakis(trichlorostannato)palladate and pentakis(trichlorostannato)platinate.

Further, they specifically include a bipyridyl complex such as chlorobis(2,2'-bipyridyl)rhodium, tris(2,2'-bipyridyl)ruthenium and diethyl(2,2'-bipyridyl)palladium; a cyclopentadienyl complex such as ferrocene, ruthenocene, dichloro(tetramethylcyclopentadienyl)rhodium dimer, dichloro(tetramethylcyclopentadienyl)iridium dimer and dichloro(pentamethylcyclopentadienyl)iridium dimer; a porphyrin complex such as chloro(tetraphenylporphyrinato)rhodium; a phthalocyanine complex such as iron phthalocyanine; a benzalacetone complex such as di(benzalacetone)palladium and tri(benzalacetone)dipalladium; and an amine complex such as dichloro(ethylenediamine)bis(tri-p-tolylphosphine)ruthenium.

Further, they specifically include an ammine complex such as hexaammine ruthenate, hexaammine rhodate and chloropentaammine ruthenate; a phenanthroline complex such as tris(1,10-phenanthroline)ruthenium and tris(1,10-phenanthroline)iron; a carbene complex such as [1,3-bis[2-(1-methyl)phenyl]-2-imidazolidinylidene]dichloro(phenylmethylene)(tricyclohexyl)ruthenium; and a salen complex such as salen cobalt.

The above metal salt and metal complex can be used as a metal catalyst in combination with a tertiary phosphine, an amine or an imidazole derivative. Specific examples of a tertiary phosphine include triphenylphosphine, trimethylphosphine, triethyiphosphine, tripropylphosphine, triisopropylphosphine, tributylphosphine, triisobutylphosphine, tri-tert-butylphosphine, trineopentylphosphine, tricyclohexylphosphine, trioctyiphosphine, triallyiphosphine, triamylphosphine, cyclohexyldiphenylphosphine, methyldiphenylphosphine, ethyldiphenylphosphine, propyldiphenylphosphine, isopropyldiphenyiphosphine, butyldiphenylphosphine, isobutyldiphenyiphosphine and tert-butyldiphenylphosphine.

Further, they specifically include 9,9-dimethyl-4,5-bis(diphenylphosphino)xanthene, 2-(diphenylphosphino)-2'-(N,N-dimethylamino)biphenyl, (R)-(+)-2-(diphenylphosphino)-2'-methoxy-1,1'-binaphthyl, 1,1'-bis(diisopropylphosphino)ferrocene, bis[2-(diphenylphosphino)phenyl]ether, (±)-2-(di-tert-butylphosphino)-1,1'-binaphthyl, 2-(di-tert-butylphosphino)biphenyl, 2-(dicyclohexylphosphino)biphenyl, 2-(dicyclohexylphosphino)-2'-methylbiphenyl, bis(diphenylphosphino)methane, 1,2-bis(diphenylphosphino)ethane, 1,2-bis(dipentafluorophenylphosphino)ethane and 1,3-bis(diphenylphosphino)propane. Further, they specifically include 1,4-bis(diphenylphosphino)butane, 1,4-bis(diphenylphosphino)pentane, 1,1'-bis(diphenylphosphino)ferrocene, tri(2-furyl)phosphine, tri(1-naphthyl)phosphine, tris[3,5-bis(trifluoromethyl)phenyl]phosphine, tris(3,5-dimethylphenyl)phosphine, tris(3-fluorophenyl)phosphine, tris(4-fluorophenyl)phosphine, tris(2-methoxyphenyl)phosphine, tris(3-methoxyphenyl)phosphine, tris(4-methoxyphenyl)phosphine, tris(2,4,6-trimethoxyphenyl)phosphine, tris(pentafluorophenyl)phosphine, tris[4-(perfluorohexyl)phenyl]phosphine, tris(2-thienyl)phosphine and tris(m-tolyl)phosphine.

Further, they specifically include tris(o-tolyl)phosphine, tris(p-tolyl)phosphine, tris(4-trifluoromethylphenyl)phosphine, tri(2,5-xylyl)phosphine, tri(3,5-xylyl)phosphine, 1,2-bis(diphenylphosphino)benzene, 2,2'-bis(diphenylphosphino)-1,1'-biphenyl, bis(2-methoxyphenyl)phenylphosphine, 1,2-bis(diphenylphosphino)benzene, tris(diethylamino)phosphine, bis(diphenylphosphino)acetylene, bis(p-sulfonatophenyl)phenylphosphine dipotassium salt, 2-dicyclohexylphosphino-2'-(N,N-dimethylamino)biphenyl, tris(trimethylsilyl)phosphine, dicyclohexyl(5"-hydroxy[1,1':4',4"-terphenylen]-2-yl)phosphonium tetrafluoroborate and diphenyl(5"-hydroxy[1,1':4',4"-terphenylen]-2-yl)phosphine.

Specific examples of an amine include ethylenediamine, 1,1,2,2-tetramethylethylenediamine, 1,3-propanediamine, N,N'-disalicylidenetrimethylenediamine, o-phenylenediamine, 1,10-phenanthroline, 2,2'-bipyridine and pyridine.

Specific examples of an imidazole derivative include imidazole, 1-phenylimidazole, 1,3-diphenylimidazole, imidazole-4,5-dicarboxylic acid, 1,3-bis[2-(1-methyl)phenyl]imidazole, 1,3-dimesityl imidazole, 1,3-bis(2,6-diisopropylphenyl)imidazole, 1,3-diadamantyl imidazole, 1,3-dicyclohexylimidazole, 1,3-bis(2,6-dimethylphenyl)

imidazole, 4,5-dihydro-1,3-dimesitylimidazole, 4,5-dihydro-1,3-bis(2,6-diisopropylphenyl)imidazole, 4,5-dihydro-1,3-diadamantyl imidazole, 4,5-dihydro-1,3-dicyclohexylimidazole and 4,5-dihydro-1,3-bis(2,6-dimethylphenyl)imidazole.

Specific examples of a zero-valent metal catalyst include Raney ruthenium, palladium sponge, platinum sponge, nickel sponge and Raney nickel. Further, an alloy such as silver-palladium may also be mentioned.

Specific examples of an oxide catalyst include nickel(II) oxide. Further, they specifically include a composite oxide such as a tantalum-iron composite oxide, an iron-tungsten composite oxide and palladium-containing perovskite.

As the supported zero-valent metal catalyst, a metal catalyst having at least one metal selected from the group consisting of ruthenium, rhodium, iridium, palladium, platinum and nickel supported by carbon such as activated carbon or graphite; an oxide such as alumina, silica, silica-alumina, titania, titanosilicate, zirconia, alumina-zirconia, magnesia, zinc oxide, chromia, strontium oxide or barium oxide; a composite hydroxide such as hydrotalcite or hydroxyapatite; zeolite such as ZSM-5, Y-zeolite, A-zeolite, X-zeolite, MCM-41 or MCM-22; an intercalation compound such as mica, tetrafluoromica or zirconium phosphate; a clay compound such as montmorillonite; or the like can be used.

They specifically include ruthenium/activated carbon, ruthenium-platinum/activated carbon, ruthenium/alumina, ruthenium/silica, ruthenium/silica-alumina, ruthenium/titania, ruthenium/zirconia, ruthenium/alumina-zirconia, ruthenium/magnesia, ruthenium/zinc oxide, ruthenium/chromia, ruthenium/strontium oxide, ruthenium/barium oxide, ruthenium/hydrotalcite, ruthenium/hydroxyapatite, ruthenium/ZSM-5, ruthenium/Y-zeolite, ruthenium/A-zeolite, ruthenium/X-zeolite, ruthenium/MCM-41, ruthenium/MCM-22, ruthenium/mica, ruthenium/tetrafluoromica, ruthenium/zirconium phosphate, rhodium/activated carbon, rhodium/Y-zeolite, iridium/activated carbon, iridium/Y-zeolite, palladium/alumina, palladium/silica, palladium/activated carbon, platinum/activated carbon, copper/alumina, copper/silica, copper-zinc/alumina, copper-zinc/silica, copper-chromium/alumina, nickel/silica and nickel/Y-zeolite.

As the supported hydroxide catalyst, a supported hydroxide catalyst having ruthenium hydroxide, rhodium hydroxide or the like supported by carbon such as activated carbon or graphite; an oxide such as alumina, silica, silica-alumina, titania, titanosilicate, zirconia, alumina-zirconia, magnesia, zinc oxide, chromia, strontium oxide or barium oxide; a composite hydroxide such as hydrotalcite or hydroxyapatite, zeolite such as ZSM-5, Y-zeolite, A-zeolite, X-zeolite, MCM-41 or MCM-22; an intercalation compound such as mica, tetrafluoromica or zirconium phosphate; a clay compound such as montmorillonite; or the like can be used. They specifically include ruthenium hydroxide/activated carbon and rhodium hydroxide/activated carbon.

In view of the good reaction efficiency, a metal catalyst containing ruthenium, rhodium or iridium is preferred. Further, more preferred is a metal catalyst having catalytic activity to convert an alcohol to hydrogen and a ketone or to hydrogen and an aldehyde, and they specifically include bis(2-methylallyl)(1,5-cyclooctadiene)ruthenium, chlorodicarbonylbis(triphenylphosphine)ruthenium, dichloro(1,5-cyclooctadiene)ruthenium, triruthenium dodecacarbonyl, (1,3,5-cyclooctatriene)tris(triethylphosphine)ruthenium, (1,3,5-cyclooctatriene)bis(dimethylfumarate)ruthenium, dichlorotricarbonylruthenium dimer, chloro(1,5-cyclooctadiene)(cyclopentadienyl)ruthenium and chloro(1,5-cyclooctadiene)(tetramethylcyclopentadienyl)ruthenium.

Further, chloro(1,5-cyclooctadiene)(ethylcyclopentadienyl)ruthenium, chloro(cyclopentadienyl)bis(triphenylphosphine)ruthenium, dicarbonyldi(η-allyl)ruthenium, tetracarbonylbis(cyclopentadienyl)diruthenium, (benzene)(cyclohexadiene)ruthenium, (benzene)(1,5-cyclooctadiene)ruthenium, (cyclopentadienyl)methyldicarbonylruthenium, chloro(cyclopentadienyl)dicarbonylruthenium, dichloro(1,5-cyclooctadiene)ruthenium, dihydrido(dinitrogen)tris(triphenylphosphine)ruthenium, dihydridotetrakis(triphenylphosphine)ruthenium, dihydridotetrakis(triethylphosphine)ruthenium, dichlorotris(phenyldimethylphosphine)ruthenium or dichlorodicarbonylbis(triphenylphosphine)ruthenium can, for example, be mentioned.

Further, tris(acetylacetonato)ruthenium, acetatodicarbonylruthenium, cis-dichloro(2,2'-bipyridyl)ruthenium, dichlorotris(triphenylphosphine)ruthenium, dichlorotris(trimethylphosphine)ruthenium, dichlorotris(triethylphosphine)ruthenium, dichlorotris(dimethylphenylphosphine)ruthenium, dichlorotris(diethylphenylphosphine)ruthenium, dichlorotris(methyldiphenylphosphine)ruthenium, dichlorotris(ethyldiphenylphosphine)ruthenium, diacetylacetonatobis(trimethylphosphine)ruthenium, diacetylacetonatobis(triethylphosphine)ruthenium, diacetylacetonatobis(tripropylphosphine)ruthenium or diacetylacetonatobis(tributylphosphine)ruthenium can, for example, be mentioned.

Further, diacetylacetonatobis(trihexylphosphine)ruthenium, diacetylacetonatobis(trioctylphosphine)ruthenium, diacetylacetonatobis(triphenylphosphine)ruthenium, diacetylacetonatobis(diphenylmethylphosphine)ruthenium, diacetylacetonatobis(dimethylphenylphosphine)ruthenium, diacetylacetonatobis(diphenylphosphinoethane)ruthenium, diacetylacetonatobis(dimethylphosphinoethane)ruthenium, ruthenocene, bis(ethylcyclopentadienyl)ruthenium, cis,trans-dichlorotetrakis(trichlorostannato)ruthenate, chloropentakis(trichlorostannato)ruthenate or hexakis(trichlorostannato)ruthenate can, for example, be mentioned.

Further, dichloro(2-tert-butylphosphinomethyl-6-diethylaminopyridine)(carbonyl)ruthenium, chlorohydrido[2,6-bis(di-tert-butylphosphinomethyl)pyridine](dinigrogen)ruthenium, acetonitrilepentakis(trichlorostannato)ruthenate, hexarhodium hexadecacarbonyl, hydridotris(triisopropylphosphine)rhodium, hydridocarbonyl(triisopropylphosphine)rhodium, trans-chlorocarbonylbis(triphenylphosphine)rhodium, bromotris(triphenylphosphine)rhodium, chlorotris(triphenylphosphine)rhodium, hydridotetrakis(triphenylphosphine)rhodium, chlorobis(2,2'-bipyridyl)rhodium, chlorodicarbonylrhodium dimer or dichloro(tetramethylcyclopentadienyl)rhodium dimer can, for example, be mentioned.

Further, tetrarhodium dodecacarbonyl, hexarhodium hexadecacarbonyl, chloro(tetraphenylporphyrinato)rhodium, chloropentakis(trichlorostannato)rhodate, hydridopentakis(trichlorostannato)iridate, cis,trans-dichlorotetrakis(trichlorostannato)iridate, pentahydridobis(triisopropylphosphine)iridium, dichloro(tetramethylcyclopentadienypiridium dimer, tetrairidium dodecacarbonyl, hexairidium hexadecacarbonyl, pentakis(trichiorostannato)platinate, cis-dichlorobis(trichlorostannato)platinate, ruthenium/activated carbon, ruthenium-platinum/activated carbon, ruthenium/alumina or ruthenium/hydroxyapatite can, for example, be mentioned.

The weight ratio of the high-valent compound to the catalyst is preferably from 5,000:1 to 0.1:1, more preferably from 1,000:1 to 1:1, in view of the good reaction efficiency.

The weight ratio of the high-valent compound to the alcohol is preferably from 1:0.05 to 1:500, more preferably from 1:0.1 to 1:200, in view of the good reaction efficiency.

The complex compound of copper, silver or indium to be used in the present invention can, for example, be copper(I) 1-butanethiolate, copper(I) hexafluoropentanedionate cyclooctadiene, copper(I) acetate, copper(II) methoxide, silver(I) 2,4-pentanedionate, solver(I) acetate, silver(I) trifluoroacetate, indium(III) hexafluoropentanedionate, indium (III) acetate or indium(III) 2,4-pentanedionate.

In view of the good reaction efficiency, preferred is copper(I) 1-butanethiolate, copper(I) hexafluoropentanedionate cyclooctadiene, silver(I) 2,4-pentanedionate or indium(III) hexafluoropentanedionate.

In the present invention, it is preferred to use a complex compound, whereby the resistivity of a metal film to be obtained will be decreased. This is considered to be because when the complex compound is reduced and deposits as a metal at the time of production of a metal film, it deposits so as to fill spaces among particles constituting the metal film, thus increasing the conductive path.

In the present invention, a solvent and/or a regulator can be used.

Specific examples of a solvent include an alcohol solvent such as methanol, ethanol, propanol, 2-propanol, butanol, pentanol, hexanol, cyclohexanol, heptanol, octanol, ethylene glycol, 1,3-propanediol, 1,2-butanediol, 1,3-butanediol, 1,4-butanediol, 2,3-butanediol, 1,6-hexanediol and glycerin; an ether solvent such as diethyl ether, tetrahydrofuran, ethylene glycol dimethyl ether, triethylene glycol dimethyl ether, tetraethylene glycol dimethyl ether, dioxane, triglyme and tetraglyme; an ester solvent such as methyl acetate, butyl acetate, benzyl benzoate, dimethyl carbonate, ethylene carbonate, γ-butyrolactone and caprolactone; a hydrocarbon solvent such as benzene, toluene, ethylbenzene, tetralin, hexane, octane and cyclohexane; a halogenated hydrocarbon solvent such as dichloromethane, trichloroethane and chlorobenzene; an amide or cyclic amide solvent such as N,N-dimethylformamide, N,N-dimethylacetamide, N-methylpyrrolidone, hexamethyiphosphoric triamide and N,N-dimethylimidazolidinone; a sulfone solvent such as dimethyl sulfone; a sulfoxide solvent such as dimethylsulfoxide; and water. Further, depending on the solubility of the catalyst to be used, such solvents can be mixed in an optional ratio. In view of the good reaction efficiency, it is preferred to use an alcohol solvent. The alcohol solvent can be one which also functions as the above-described linear, branched or cyclic $C_{1-18}$ alcohol.

Specific examples of a regulator include a binder agent to improve the adhesion to the substrate or a medium, a leveling agent and an antifoaming agent to realize favorable patterning properties, a thickener to adjust the viscosity and a rheology modifier.

Specific examples of a binder include an epoxy resin, a maleic anhydride-modified polyolefin, an acrylate, a polyethylene, a polyethylene oxidate, an ethylene-acrylic acid copolymer, an ethylene-acrylate copolymer, an acrylate rubber, a polyisobutyrene, an atactic polypropylene, a polyvinyl butyral, an acrylonitrile-butadienen copolymer, a styrene-isoprene block copolymer, a polybutadiene, ethyl cellulose, a polyester, a polyamide, a natural rubber, a synthetic rubber such as a silicon rubber and a polychloroprene, a polyvinyl ether, a methacrylate, a vinyl pyrrolidone-vinyl acetate copolymer, polyvinyl pyrrolidone, polyisopropyl acrylate, a polyurethane, an acrylic resin, a cyclized rubber, a butyl rubber, a hydrocarbon resin, an α-methylstyrene-acrylonitrile copolymer, a polyesterimide, butyl acrylate, a polyacrylate, a polyurethane, an aliphatic polyurethane, a chlorosulfonated polyethylene, a polyolefin, a polyvinyl compound, an acrylate resin, a melamine resin, a urea resin, a phenol resin, a polyester acrylate and an unsaturated ester of a polyvalent carboxylic acid.

Specific examples of a leveling agent include a fluorine type surfactant, a silicone, an organic modified polysiloxane, a polyacrylate, methyl acrylate, methyl methacrylate, ethyl acrylate, ethyl methacrylate, n-propyl acrylate, n-propyl methacrylate, isopropyl acrylate, isopropyl methacrylate, n-butyl acrylate, n-butyl methacrylate, sec-butyl acrylate, sec-butyl methacrylate, isobutyl acrylate, isobutyl methacrylate, tert-butyl acrylate, tert-butyl methacrylate, allyl acrylate, allyl methacrylate, benzyl acrylate, benzyl methacrylate, cyclohexyl acrylate and cyclohexyl methacrylate.

Specific examples of an antifoaming agent include silicone, a surfactant, a polyether, a higher alcohol, a glycerin higher fatty acid ester, a glycerin acetic acid higher fatty acid ester, a glycerin lactic acid higher fatty acid ester, a glycerin citric acid higher fatty acid ester, a glycerin succinic acid higher fatty acid ester, a glycerin diacetyl tartaric acid higher fatty acid ester, a glycerin acetic acid ester, a polyglycerin higher fatty acid ester, and a polyglycerin condensed ricinoleate.

Specific examples of a thickener include polyvinyl alcohol, polyacrylate, polyethylene glycol, polyurethane, hydrogenated caster oil, aluminum stearate, zinc stearate, aluminum octylate, fatty acid amide, polyethylene oxide, dextrin fatty acid ester, dibenzylidene sorbitol, a vegetable oil type polymerized oil, surface treated calcium carbonate, organic bentonite, silica, hydroxyethyl cellulose, methyl cellulose, carboxymethyl cellulose, sodium alginate, casein, sodium caseinate, xanthane rubber, a polyether urethane modified product, a poly(acrylic acid-acrylate) and montmorillonite.

Specific examples of a rheology modifier include oxidized polyolefin amide, a fatty acid amide type, an oxidized polyolefin type, a urea-modified urethane, methylene diisocyanate, trimethylene diisocyanate, tetramethylene diisocyanate, hexamethylene diisocyanate, ω,ω'dipropylether diisocyanate, thiodipropyl diisocyanate, cyclohexyl-1,4-diisocyanate, dicyclohexyl methane-4,4'-diisocyanate, 1,5-dimethyl-2,4-bis(isocyanatomethyl)-benzene, 1,5-dimethyl-2,4-bis(ω-isocyanatoethyl)-benzene, 1,3,5-trimethyl-2,4-bis (isocyanatomethyl)benzene and 1,3,5-triethyl-2,4-bis (isocyanatomethyl)benzene.

The viscosity of the composition can properly be selected depending on the method for producing the metal film. For example, in a method by a screen printing method, a relatively high viscosity is suitable, and the viscosity preferably is from 10 to 200 Pas, more preferably from 50 to 150 Pas. Further, in a method by an ink jet method, a low viscosity is suitable, and the viscosity is preferably from 1 to 50 mPas, more preferably from 5 to 30 mPas. Further, in a method by an offset printing method, a relatively high viscosity is suitable, and the viscosity is preferably from 20 to 100 Pas. Further, in a method by a gravure printing method, a relatively low viscosity is suitable, and the viscosity is preferably from 50 to 200 mPas. Further, in a method by a flexographic printing method, a relatively low viscosity is suitable, and the viscosity is preferably from 50 to 500 mPas.

By using the composition of the present invention, a metal film can be produced by forming a coating film on a substrate or a medium of e.g. a ceramic, glass or a plastic, followed by reduction by heating. As a method of forming a coating film on a substrate or a medium, a screen printing method, a spin coating method, a casting method, a dipping method, an ink jet method or a spray method can, for example, be used.

The temperature at the time of the reduction by heating depends on the thermal stability of the high-valent metal compound and the metal catalyst used, and the boiling point of the alcohol and the solvent, and is preferably from 50° C. to 200° C. from the economical viewpoint. It is more preferably from 50° C. to 150° C.

The method for producing a metal powder or a metal film of the present invention may be carried out either in an open system or a closed system. In a case where the production of a metal powder is carried out in an open system, it is possible that a condenser is attached and the alcohol or the solvent is refluxed. Further, at the time of production of a metal film, it is preferred that the coating film formed on a substrate is covered with a lid and heated, whereby evaporation of the alcohol is properly suppressed, and such is well utilized for reduction of the high-valent compound.

Such a production method of the present invention may be carried out in an atmosphere of an inert gas such as nitrogen, argon, xenon, neon, krypton or helium, oxygen, hydrogen or the air. In view of the good reaction efficiency, it is preferably carried out in an inert gas. Further, production under reduced pressure is also possible depending on the temperature at the time of the reduction by heating and the vapor pressure of the alcohol to be used.

The time required for the reduction by heating depends on the temperature and is preferably from one minute to 2 hours. A metal powder or a metal film can be sufficiently produced even in one hour or shorter by selecting proper conditions.

The metal film obtainable by the present invention can be used for e.g. a conductive pattern film, a light-transmitting conductive film, an electromagnetic wave shielding film or an anti-fogging film.

EXAMPLES

Now, the present invention will be described in further detail with reference to Examples. However, it should be understood that the present invention is by no means restricted thereto.

Example 1

A solution having 0.06 g of triruthenium dodecacarbonyl dissolved in a liquid having 12.5 mL of 1,3-butanediol and 12.5 g of 1,4-cyclohexanediol mixed, was prepared. 0.1 g of this solution and 0.04 g of copper(I) nitride (fine particles by spray pyrolysis method, average particle size: 30 nm) were mixed, followed by printing on a polyimide substrate by a screen printing method. Then, in a nitrogen atmosphere, the temperature was increased at a rate of 100° C./min, followed by heating at 200° C. for one hour. The thickness of a film thus obtained was 12 μm, and the resistivity was 1,700 μΩcm.

Example 2

The same operation as in Example 1 was carried out except that heating was carried out at 160° C. The thickness of a film obtained was 13 μm, and the resistivity was 3,800 μΩcm.

Example 3

The same operation as in Example 1 was carried out except that 0.018 g of an epoxy resin (manufactured by TOAGOSEI CO., LTD., grade: AS-60) was mixed with the solution in Example 1, and the thickness of a film obtained was 10 μm, and the resistivity was 350 μΩcm. The X-ray diffraction pattern of the obtained film was measured, whereupon diffraction peaks derived from metallic copper were confirmed as shown in FIG. 1.

Example 4

The same operation as in Example 1 was carried out except that 0.06 g of a solution having 1.1 g of maleic anhydride modified polyolefin dissolved in 10 g of toluene was mixed with the solution in Example 1. The thickness of a film obtained was 12 μm, and the resistivity was 4,900 μΩcm.

Example 5

The same operation as in Example 3 was carried out except that the amount of the solution was changed from 0.1 g to 0.4 g. The thickness of a film obtained was 13 μm, and the resistivity was 530 μΩcm.

Example 6

The same operation as in Example 3 was carried out except that the amount of the solution was changed from 0.1 g to 0.12 g, and the amount of copper(I) nitride was changed from 0.04 g to 0.06 g. The thickness of a film obtained was 25 μm, and the resistivity was 180 μΩcm.

Example 7

Figure 2:
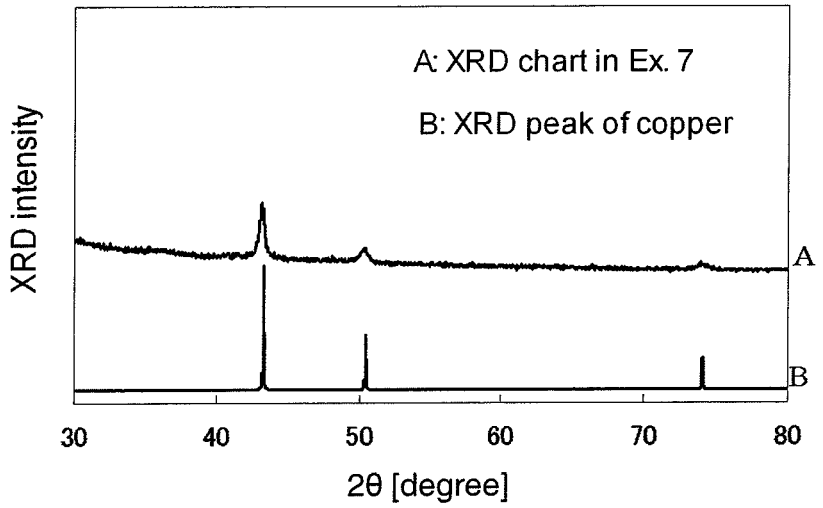
FIG. 2 is a diagram illustrating an X-ray diffraction pattern of a film after heating in Example 7.

A solution having 0.08 g of triruthenium dodecacarbonyl dissolved in 37 mL of 1,3-butanediol was prepared. 0.1 g of this solution and 0.04 g of copper(I) nitride (fine particles by spray pyrolysis method, average particle size: 30 nm) were mixed, followed by printing on a polyimide substrate by a screen printing method. Then, in a nitrogen atmosphere, the temperature was increased at a rate of 100° C./min, followed by heating at 200° C. for one hour. The thickness of a film thus obtained was 14 μm, and the resistivity was 1,800 μΩcm. The X-ray diffraction pattern of the obtained film was measured, whereupon diffraction peaks derived from metallic copper were confirmed as shown in FIG. 2.

Example 8

Figure 3:
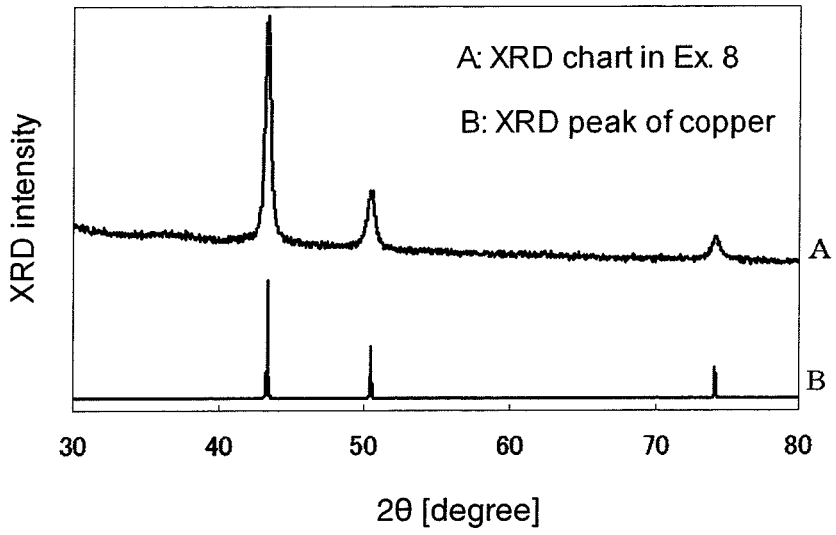
FIG. 3 is a diagram illustrating an X-ray diffraction pattern of a film after heating in Example 8.

A solution having 0.06 g of triruthenium dodecacarbonyl dissolved in a liquid having 16 mL of 1,3-butanediol and 8.0 g of 1,4-cyclohexanediol mixed, was prepared. 0.1 g of this solution and 0.04 g of copper(I) nitride (fine particles by spray pyrolysis method, average particle size: 30 nm) were mixed, followed by printing on a polyimide substrate by a screen printing method. Then, in a nitrogen atmosphere, the temperature was increased at a rate of 100° C./min, followed by heating at 200° C. for one hour. The thickness of a film thus obtained was 10 μm, and the resistivity was 2,000 μΩcm. The X-ray diffraction pattern of the obtained film was measured, whereupon diffraction peaks derived from metallic copper were confirmed as shown in FIG. 3.

Example 9

A solution having 0.06 g of triruthenium dodecacarbonyl dissolved in 29 mL of cyclohexanol was prepared. 0.12 g of this solution and 0.04 g of copper(I) nitride (manufactured by Kojundo Chemical Laboratory Co., Ltd., average particle size: 5 μm) were mixed, and the mixture was applied on a glass substrate by a casting method, followed by heating in a nitrogen atmosphere at 145° C. for 5 hours. The X-ray diffraction pattern of a film-form solid thus obtained was measured, whereupon diffraction peaks derived from metallic copper were confirmed.

Example 10

The same operation as in Example 9 was carried out except that heating was carried out at 150° C., whereupon diffraction peaks derived from metallic copper were confirmed.

Example 11

The same operation as in Example 9 was carried out except that heating was carried out at 150° C. for 3 hours, whereupon diffraction peaks derived from metallic copper were confirmed.

Example 12

Figure 4:
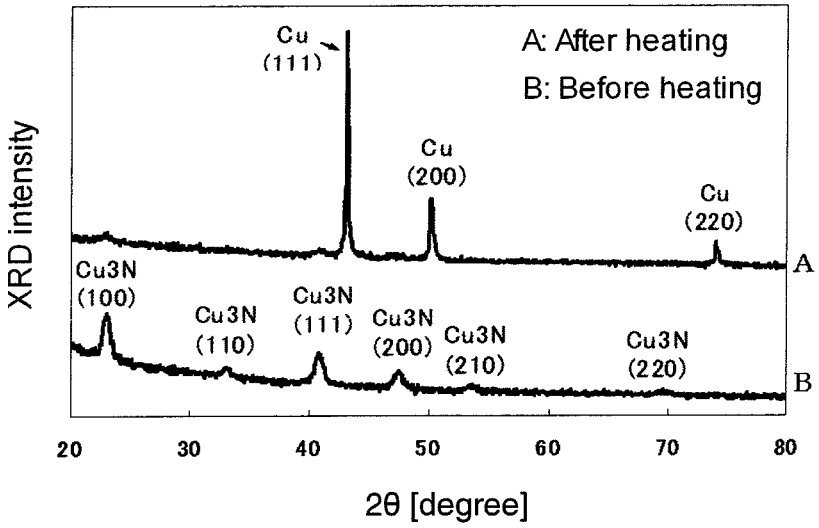
FIG. 4 is a diagram illustrating X-ray diffraction patterns of a film-form solid before and after heating in Example 12.

A solution having 0.08 g of triruthenium dodecacarbonyl dissolved in 40 mL of ethylene glycol was prepared. 1.2 g of this solution and 0.01 g of copper(I) nitride (fine particles by spray pyrolysis method, average particle size: 30 nm) were mixed, and the mixture was applied on a glass substrate by a casting method, followed by heating in a nitrogen atmosphere at 130° C. for one hour. The X-ray diffraction pattern of a film-form solid thus obtained was measured, whereupon diffraction peaks derived from metallic copper were confirmed as shown in FIG. 4.

Example 13

The same operation as in Example 12 was carried out except that the amount of the solution was changed from 1.2 g to 1.0 g, whereupon diffraction peaks derived from metallic copper were confirmed.

Example 14

The same operation as in Example 12 was carried out except that the amount of the solution was changed from 1.2 g to 0.8 g, whereupon diffraction peaks derived from metallic copper were confirmed.

Example 15

The same operation as in Example 12 was carried out except that the amount of the solution was changed from 1.2 g to 0.2 g, whereupon diffraction peaks derived from metallic copper were confirmed.

Example 16

Figure 5:
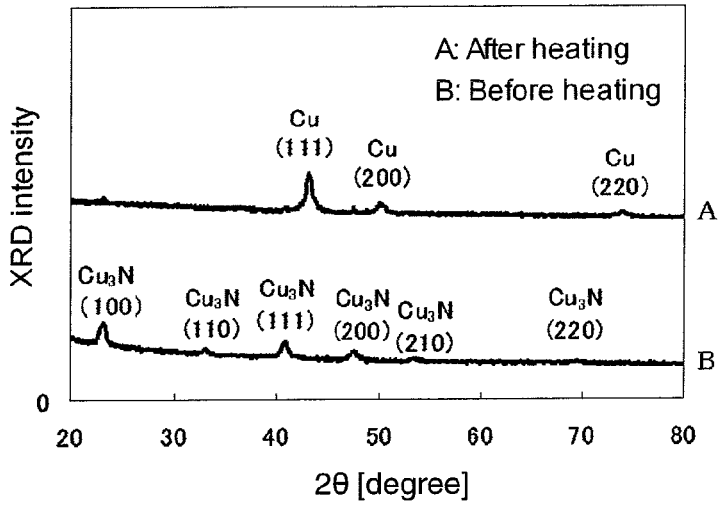
FIG. 5 is a diagram illustrating X-ray diffraction patterns of a film-form solid before and after heating in Example 16.

A solution having 0.08 g of triruthenium dodecacarbonyl dissolved in 36 mL of 1,3-butanediol was prepared. 0.8 g of this solution and 0.01 g of copper(I) nitride (fine particles by spray pyrolysis method, average particle size: 30 nm) were mixed, and the mixture was applied on a glass substrate by a casting method, followed by heating in a nitrogen atmosphere at 130° C. for one hour. The X-ray diffraction pattern of a film-form solid thus obtained was measured, whereupon diffraction peaks derived from metallic copper were confirmed as shown in FIG. 5.

Example 17

The same operation as in Example 16 was carried out except that the amount of the solution was changed from 0.8 g to 0.4 g, whereupon diffraction peaks derived from metallic copper were confirmed.

Example 18

The same operation as in Example 16 was carried out except that the amount of the solution was changed from 0.8 g to 0.2 g, whereupon diffraction peaks derived from metallic copper were confirmed.

Example 19

The same operation as in Example 16 was carried out except that the amount of the solution was changed from 0.8 g to 0.1 g, whereupon diffraction peaks derived from metallic copper were confirmed.

Example 20

The same operation as in Example 16 was carried out except that the amount of the solution was changed from 0.8 g to 0.05 g, whereupon diffraction peaks derived from metallic copper were confirmed.

Example 21

The same operation as in Example 16 was carried out except that the amount of the solution was changed from 0.8 g to 1.7 g, and the heating was carried out at 100° C., whereupon diffraction peaks derived from metallic copper were confirmed.

Example 22

The same operation as in Example 16 was carried out except that the amount of the solution was changed from 0.8 g to 1.7 g, and the heating was carried out at 115° C., whereupon diffraction peaks derived from metallic copper were confirmed.

Example 23

The same operation as in Example 16 was carried out except that the amount of the solution was changed from 0.8 g to 1.7 g, whereupon diffraction peaks derived from metallic copper were confirmed.

Example 24

The same operation as in Example 16 was carried out except that the amount of the solution was changed from 0.8 g to 1.7 g, and the heating was carried out for 30 minutes, whereupon diffraction peaks derived from metallic copper were confirmed.

Example 25

The same operation as in Example 16 was carried out except that the amount of the solution was changed from 0.8 g to 1.7 g, and the heating was carried out for 15 minutes, whereupon diffraction peaks derived from metallic copper were confirmed.

Example 26

The same operation as in Example 16 was carried out except that the amount of the solution was changed from 0.8 g to 0.1 g, and the heating was carried out for 15 minutes, whereupon diffraction peaks derived from metallic copper were confirmed.

Example 27

The same operation as in Example 16 was carried out except that the amount of the solution was changed from 0.8 g to 0.1 g, and the heating was carried out at 150° C. for 30 minutes, whereupon diffraction peaks derived from metallic copper were confirmed.

Example 28

The same operation as in Example 16 was carried out except that the amount of the solution was changed from 0.8 g to 0.1 g, and the heating was carried out at 150° C. for 15 minutes, whereupon diffraction peaks derived from metallic copper were confirmed.

Example 29

The same operation as in Example 16 was carried out except that the amount of the solution was changed from 0.8 g to 0.1 g, and the heating was carried out at 170° C. for 15 minutes, whereupon diffraction peaks derived from metallic copper were confirmed.

Example 30

The same operation as in Example 16 was carried out except that the amount of the solution was changed from 0.8 g to 0.1 g, and the heating was carried out at 170° C. for 5 minutes, whereupon diffraction peaks derived from metallic copper were confirmed.

Example 31

The same operation as in Example 16 was carried out except that the amount of the solution was changed from 0.8 g to 0.2 g, and the heating was carried out at 130° C. for one hour, whereupon diffraction peaks derived from metallic copper were confirmed.

Example 32

The same operation as in Example 16 was carried out except that the amount of the solution was changed from 0.8 g to 0.2 g, and the heating was carried out at 150° C. for 30 minutes, whereupon diffraction peaks derived from metallic copper were confirmed.

Example 33

The same operation as in Example 16 was carried out except that the amount of the solution was changed from 0.8 g to 0.2 g, and the heating was carried out at 150° C. for 15 minutes, whereupon diffraction peaks derived from metallic copper were confirmed.

Example 34

The same operation as in Example 16 was carried out except that the amount of the solution was changed from 0.8 g to 0.2 g, and the heating was carried out at 170° C. for 15 minutes, whereupon diffraction peaks derived from metallic copper were confirmed.

Example 35

The same operation as in Example 16 was carried out except that the amount of the solution was changed from 0.8 g to 0.2 g, and the heating was carried out at 170° C. for 5 minutes, whereupon diffraction peaks derived from metallic copper were confirmed.

Example 36

The same operation as in Example 16 was carried out except that the amount of the solution was changed from 0.8 g to 0.4 g, and the heating was carried out at 130° C. for one hour, whereupon diffraction peaks derived from metallic copper were confirmed.

Example 37

The same operation as in Example 16 was carried out except that the amount of the solution was changed from 0.8 g to 0.4 g, and the heating was carried out at 150° C. for one hour, whereupon diffraction peaks derived from metallic copper were confirmed.

Example 38

A solution having 0.01 g of triruthenium dodecacarbonyl dissolved in 20 mL of 1,3-butanediol was prepared. 0.8 g of this solution and 0.01 g of copper(I) nitride (fine particles by spray pyrolysis method, average particle size: 30 nm) were mixed, and the mixture was applied on a glass substrate by a casting method, followed by heating in a nitrogen atmosphere at 150° C. for one hour. The X-ray diffraction pattern of a film-form solid thus obtained was measured, whereupon diffraction peaks derived from metallic copper were confirmed.

Example 39

A solution having 0.005 g of triruthenium dodecacarbonyl dissolved in 20 mL of 1,3-butanediol was prepared. 0.8 g of this solution and 0.01 g of copper(I) nitride (fine particles by spray pyrolysis method, average particle size: 30 nm) were mixed, and the mixture was applied on a glass substrate by a casting method, followed by heating in a nitrogen atmosphere at 150° C. for one hour. The X-ray diffraction pattern of a film-form solid thus obtained was measured, whereupon diffraction peaks derived from metallic copper were confirmed.

Example 40

A solution having 0.005 g of triruthenium dodecacarbonyl dissolved in 20 mL of 1,3-butanediol was prepared. 0.4 g of this solution and 0.01 g of copper(I) nitride (fine particles by spray pyrolysis method, average particle size: 30 nm) were mixed, and the mixture was applied on a glass substrate by a casting method, followed by heating in a nitrogen atmosphere at 150° C. for one hour. The X-ray diffraction pattern of a film-form solid thus obtained was measured, whereupon diffraction peaks derived from metallic copper were confirmed.

Example 41

A solution having 0.005 g of triruthenium dodecacarbonyl dissolved in 20 mL of 1,3-butanediol was prepared. 0.2 g of this solution and 0.01 g of copper(I) nitride (fine particles by spray pyrolysis method, average particle size: 30 nm) were mixed, and the mixture was applied on a glass substrate by a casting method, followed by heating in a nitrogen atmosphere at 150° C. for one hour. The X-ray diffraction pattern of a film-form solid thus obtained was measured, whereupon diffraction peaks derived from metallic copper were confirmed.

Example 42

A solution having 0.0027 g of triruthenium dodecacarbonyl dissolved in 20 mL of 1,3-butanediol was prepared. 0.2 g of this solution and 0.01 g of copper(I) nitride (fine particles by spray pyrolysis method, average particle size: 30 nm) were mixed, and the mixture was applied on a glass substrate by a casting method, followed by heating in a nitrogen atmosphere at 150° C. for one hour. The X-ray diffraction pattern of a film-form solid thus obtained was measured, whereupon diffraction peaks derived from metallic copper were confirmed.

Example 43

A solution having 0.08 g of triruthenium dodecacarbonyl dissolved in 35 mL of cyclohexanol was prepared. 1.2 g of this solution and 0.01 g of copper(I) nitride (fine particles by spray pyrolysis method, average particle size: 30 nm) were mixed, and the mixture was applied on a glass substrate by a casting method, followed by heating in a nitrogen atmosphere at 150° C. for one hour. The X-ray diffraction pattern of a film-form solid thus obtained was measured, whereupon diffraction peaks derived from metallic copper were confirmed. Further, the resistivity of the film-form solid was 57,400 μΩcm.

Example 44

A solution having 0.08 g of triruthenium dodecacarbonyl dissolved in 40 mL of ethylene glycol was prepared. 1.2 g of this solution and 0.01 g of copper(I) nitride (fine particles by spray pyrolysis method, average particle size: 30 nm) were mixed, and the mixture was applied on a glass substrate by a casting method, followed by heating in a nitrogen atmosphere at 150° C. for one hour. The X-ray diffraction pattern of a film-form solid thus obtained was measured, whereupon diffraction peaks derived from metallic copper were confirmed. Further, the resistivity of the obtained film-form solid was 12,400 μΩcm.

Example 45

A solution having 0.08 g of triruthenium dodecacarbonyl mixed with 36 mL of glycerin was prepared. 1.2 g of this solution and 0.01 g of copper(I) nitride (fine particles by spray pyrolysis method, average particle size: 30 nm) were mixed, and the mixture was applied on a glass substrate by a casting method, followed by heating in a nitrogen atmosphere at 150° C. for one hour. The X-ray diffraction pattern of a film-form solid thus obtained was measured, whereupon diffraction peaks derived from metallic copper were confirmed.

Example 46

A solution having 0.08 g of triruthenium dodecacarbonyl dissolved in 37 mL of 1,3-butanediol was prepared. 1.2 g of this solution and 0.01 g of copper(I) nitride (fine particles by spray pyrolysis method, average particle size: 30 nm) were mixed, and the mixture was applied on a glass substrate by a casting method, followed by heating in a nitrogen atmosphere at 150° C. for one hour. The X-ray diffraction pattern of a film-form solid thus obtained was measured, whereupon diffraction peaks derived from metallic copper were confirmed. Further, the resistivity of the film-form solid was 622 μΩcm.

Example 47

A solution having 0.08 g of triruthenium dodecacarbonyl dissolved in 36 mL of 1,3-butanediol was prepared. 0.2 g of this solution and 0.01 g of copper(I) nitride (fine particles by spray pyrolysis method, average particle size: 30 nm) were mixed, and the mixture was applied on a glass substrate by a casting method, followed by heating in a nitrogen atmosphere at 150° C. for 30 minutes. The resistivity of a film-form solid thus obtained is shown in Table 1.

Example 48

The same operation as in Example 47 was carried out except that heating was carried out at 150° C. for 15 minutes. The resistivity of a film-form solid thus obtained is shown in Table 1.

Example 49

The same operation as in Example 47 was carried out except that heating was carried out at 170° C. for 15 minutes. The resistivity of a film-form solid thus obtained is shown in Table 1.

Example 50

The same operation as in Example 47 was carried out except that the amount of the solution was changed from 0.2 g to 0.1 g, and the heating was carried out at 150° C. for 15 minutes. The resistivity of a film-form solid thus obtained is shown in Table 1.

TABLE 1

| | Amount of solution (g) | Amount of copper compound (g) | Heating conditions Temperature (° C.) | Heating conditions Time (min) | Resistivity (μΩcm) |
|---|---|---|---|---|---|
| Ex. 47 | 0.2 | 0.01 | 150 | 30 | 629 |
| Ex. 48 | 0.2 | 0.01 | 150 | 15 | 724 |
| Ex. 49 | 0.2 | 0.01 | 170 | 15 | 307 |
| Ex. 50 | 0.1 | 0.01 | 150 | 15 | 181 |

Example 51

A solution having 0.08 g of triruthenium dodecacarbonyl dissolved in 37 mL of 1,3-butanediol was prepared. 0.4 g of this solution and 0.01 g of copper(II) oxide (fine particles by spray pyrolysis method, average particle size: 30 nm) were mixed, and the mixture was applied on a glass substrate by a casting method, followed by heating in a nitrogen atmosphere at 150° C. for one hour. The X-ray diffraction pattern of a film-form solid thus obtained was measured, whereupon diffraction peaks derived from metallic copper were confirmed. Further, the resistivity of the film-form solid was 258 μΩcm.

Example 52

A solution having 0.05 g of triruthenium dodecacarbonyl dissolved in a liquid having 12.5 mL of 1,3-butanediol and 12.6 g of 1,4-cyclohexanediol mixed, was prepared. 0.1 g of this solution an 0.01 g of copper(I) nitride (fine particles by spray pyrolysis method, average particle size: 30 nm) were mixed, and the mixture was applied on a glass substrate by a casting method, followed by heating in a nitrogen atmosphere at 190° C. for one hour. The resistivity of a film-form solid obtained was 59 μΩcm.

Example 53

The same operation as in Example 52 was carried out except that 0.01 g of copper(I) nitride (fine particles by spray pyrolysis method, average particle size: 30 nm) was changed to 0.01 g copper(II) oxide (fine particles by spray pyrolysis method, average particle size: 30 nm). The resistivity of a film-form solid obtained was 16,870 μΩcm.

Example 54

A solution having 0.06 g of triruthenium dodecacarbonyl dissolved in a liquid having 8 mL of 1,3-butanediol and 16.5 g of 1,4-cyclohexanediol mixed, was prepared. 0.1 g of this solution and 0.02 g of copper(I) nitride (fine particles by spray pyrolysis method, average particle size: 30 nm) were mixed, followed by printing on a glass substrate by a screen printing method. Then, heating was carried out in a nitrogen atmosphere at 190° C. for one hour. The resistivity of a film-form solid obtained was 76 μΩcm.

Example 55

A solution having 0.06 g of triruthenium dodecacarbonyl dissolved in a liquid having 8 mL of 1,3-butanediol and 16.5 g of 1,4-cyclohexanediol mixed, was prepared. 0.1 g of this solution, 0.02 g of copper(I) nitride (fine particles by spray pyrolysis method, average particle size: 30 nm) and epoxy acrylate as an adhesive were mixed, followed by printing on a glass substrate by a screen printing method. Then, heating was carried out in a nitrogen atmosphere at 190° C. for one hour. The resistivity of a film-form solid obtained was 313 μΩcm.

Example 56

Figure 6:
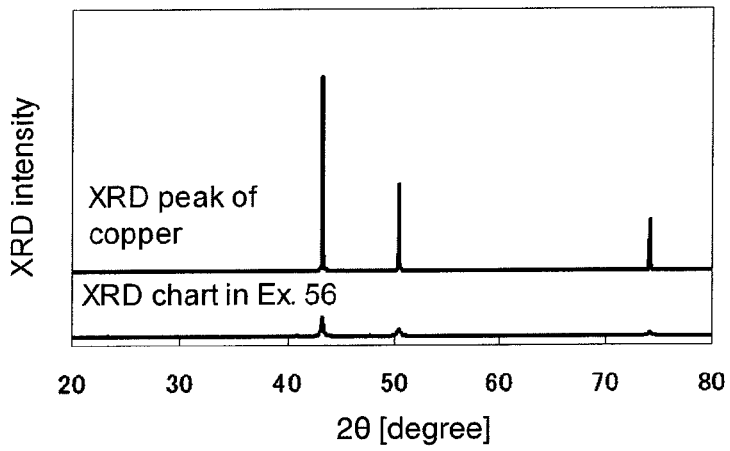
FIG. 6 is a diagram illustrating an X-ray diffraction pattern of a powder after heating in Example 56.

0.01 g of triruthenium dodecacarbonyl, 2.0 g of copper(I) nitride (manufactured by Kojundo Chemical Laboratory Co., Ltd., average particle size: 5 μm) and 5 mL of cyclohexanol were put in a Schlenk tube, and a reflux condenser was attached, followed by heating in a nitrogen atmosphere at 150° C. for 20 hours. The mixture was subjected to filtration to obtain a powder, of which the X-ray diffraction pattern (XRD) was measured, whereupon diffraction peaks derived from metallic copper were confirmed as shown in FIG. 6.

Example 57

The same operation as in Example 56 was carried out except that 2.0 g of copper(I) nitride was changed to 2.0 g of copper(II) oxide, whereupon diffraction peaks derived from metallic copper were confirmed.

Example 58

The same operation as in Example 56 was carried out except that 0.01 g of triruthenium dodecacarbonyl was changed to 0.05 g of dihydridotetrakis(triphenylphosphine) ruthenium, and 5 mL of cyclohexanol was changed to 5 mL of 1,3-butanediol, whereupon diffraction peaks derived from metallic copper were confirmed. Further, the particle size distribution of a powder obtained was measured, whereupon the average particle size was 5 μm.

Example 59

The same operation as in Example 56 was carried out except that 0.01 g of triruthenium dodecacarbonyl was changed to 0.04 g of dichlorotris(triphenylphosphine)ruthenium, and 5 mL of cyclohexanol was changed to 5 mL of 1,3-butanediol, whereupon diffraction peaks derived from metallic copper were confirmed. Further, the particle size distribution of a powder was measured, whereupon the average particle size was 3 μm.

Example 60

The same operation as in Example 56 was carried out except that 0.01 g of triruthenium dodecacarbonyl was changed to a catalyst having 5 wt % each of ruthenium and platinum supported by 0.15 g of activated carbon, and 5 mL of cyclohexanol was changed to 20 mL of isopropyl alcohol, and heating was carried out at 110° C., whereupon diffraction peaks derived from metallic copper were confirmed.

Example 61

The same operation as in Example 56 was carried out except that heating was carried out at 170° C., whereupon diffraction peaks derived from metallic copper were confirmed.

Example 62

The same operation as in Example 56 was carried out except that heating was carried out for 5 hours, whereupon diffraction peaks derived from metallic copper were confirmed.

Example 63

The same operation as in Example 56 was carried out except that heating was carried out at 100° C., whereupon diffraction peaks derived from metallic copper were confirmed.

Example 64

The same operation as in Example 56 was carried out except that 2.0 g of copper(I) nitride was changed to 2.0 g of copper(I) oxide, and heating was carried out for 15 hours, whereupon diffraction peaks derived from metallic copper were confirmed.

Example 65

The same operation as in Example 56 was carried out except that 2.0 g of copper(I) nitride was changed to 2.0 g of silver(I) carbonate, and 5 mL of cyclohexanol was changed to 5 mL of 1,3-butanediol, whereupon diffraction peaks derived from metallic silver were confirmed.

Example 66

Figure 7:
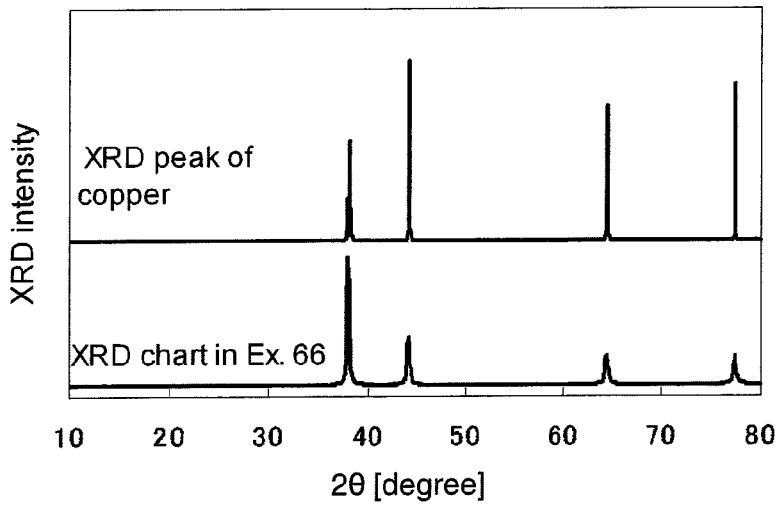
FIG. 7 is a diagram illustrating an X-ray diffraction pattern of a powder after heating in Example 66.

The same operation as in Example 56 was carried out except that 2.0 g of copper(I) nitride was changed to 2.0 g of silver(I) oxide, and 5 mL of cyclohexanol was changed to 5 mL of 1,3-butanediol, whereupon diffraction peaks derived from metallic silver were confirmed. The results are shown in FIG. 7.

Example 67

The same operation as in Example 56 was carried out except that 2.0 g of copper(I) nitride was changed to 2.0 g of indium(III) oxide, and 5 mL of cyclohexanol was changed to 5 mL of 1,3-butanediol, whereupon diffraction peaks derived from metallic indium were confirmed.

Example 68

The same operation as in Example 56 was carried out except that 0.01 g of triruthenium dodecacarbonyl was changed to 0.008 g of hexarhodium hexadecacarbonyl, and 5 mL of cyclohexanol was changed to 5 mL of 1,3-butanediol, whereupon diffraction peaks derived from metallic copper were confirmed.

Example 69

The same operation as in Example 56 was carried out except that 0.01 g of triruthenium dodecacarbonyl was changed to 0.06 g of trans-chlorocarbonylbis(triphenylphosphine)rhodium, and 5 mL of cyclohexanol was changed to 5 mL of 1,3-butanediol, whereupon diffraction peaks derived from metallic copper were confirmed.

Example 70

The same operation as in Example 56 was carried out except that 0.01 g of triruthenium dodecacarbonyl was changed to 0.01 g of tetrairidium dodecacarbonyl, and 5 mL of cyclohexanol was changed to 5 mL of 1,3-butanediol, whereupon diffraction peaks derived from metallic copper were confirmed.

Example 71

In a Schlenk tube, 0.025 g of sodium hexachloroiridium hexahydrate and 0.06 g of tin dichloride dihydrate were added in 5 mL of 1,3-butanediol to generate hydridopentakis (trichlorostannato)iridate. 2.0 g of copper(I) nitride (manufactured by Kojundo Chemical Laboratory Co., Ltd., average particle size: 5 μm) was added, and a reflux condenser was attached, followed by heating in a nitrogen atmosphere at 150° C. for 20 hours. The mixture was subjected to filtration to obtain a powder, of which the X-ray diffraction pattern was measured, whereupon diffraction peaks derived from metallic copper were confirmed.

Comparative Example 1

Figure 8:
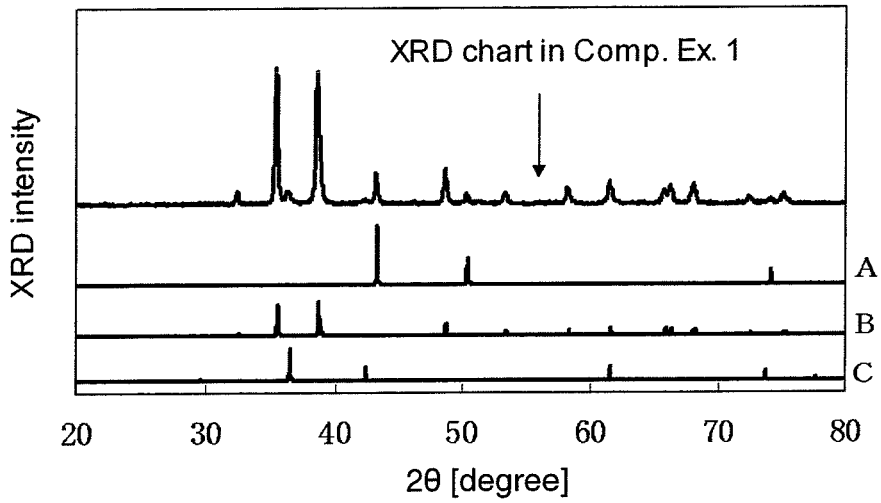
FIG. 8 is a diagram illustrating an X-ray diffraction pattern of a powder after heating in Comparative Example 1.

2.0 g of copper(II) oxide and 5 mL of cyclohexanol were put in a Schlenk tube, and a reflux condenser was attached, followed by heating in a nitrogen atmosphere at 150° C. for 20 hours. The mixture was subjected to filtration to obtain a powder, of which the X-ray diffraction pattern was measured, whereupon diffraction peaks derived from metallic copper were very small as shown in FIG. 8.

Comparative Example 2

Figure 9:
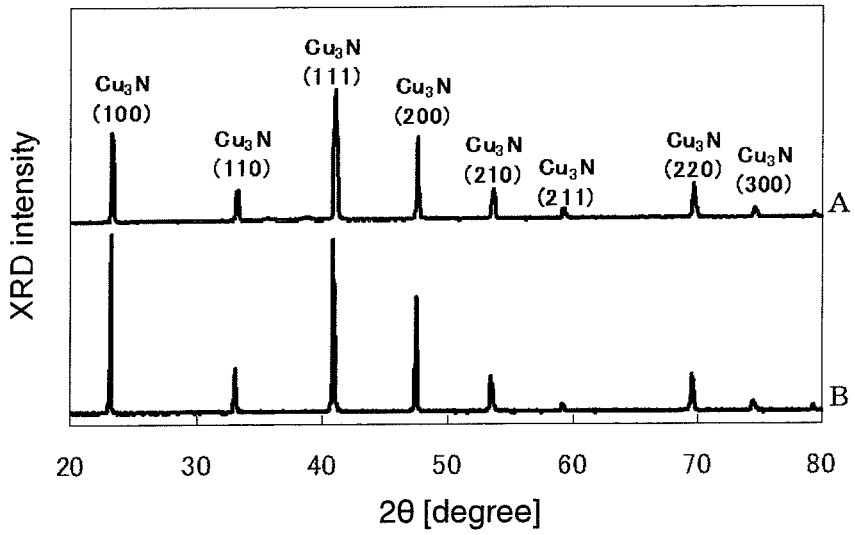
FIG. 9 is a diagram illustrating X-ray diffraction patterns of a powder before and after heating in Comparative Example 2.

5.0 g of copper(I) nitride (manufactured by Kojundo Chemical Laboratory Co., Ltd., average particle size: 5 μm) and 20 mL of isopropyl alcohol were put in a Schlenk tube, and a reflux condenser was attached, followed by heating in a nitrogen atmosphere at 110° C. for 20 hours. The mixture was subjected to filtration to obtain a powder, of which the X-ray diffraction pattern was measured, whereupon no diffraction peak derived from metallic copper was confirmed as shown in FIG. 9.

Example 72

Figure 10:
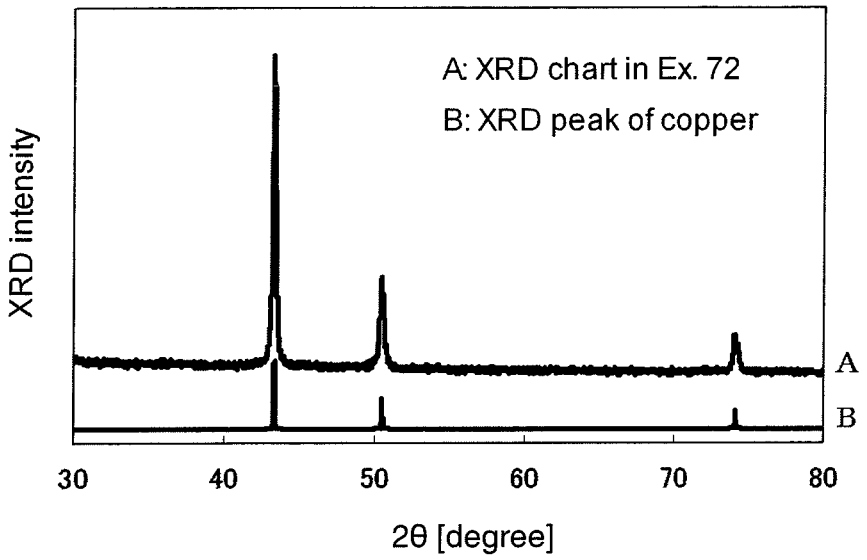
FIG. 10 is a diagram illustrating an X-ray diffraction pattern of a film after heating in Example 72.

A solution having 0.09 g of triruthenium dodecacarbonyl dissolved in 20.0 mL of 1,3-butanediol was prepared. 0.092 g of this solution, 0.25 g of copper nano particles (manufactured by NISSHIN ENGINEERING INC., average particle size: 100 nm, average surface oxide layer: 10 nm (as observed and measured by transmission electron microscope (TEM)) and 0.043 g of an epoxy resin (manufactured by Toagosei Co., Ltd., grade: BX-60BA) were mixed, followed by printing on a polyimide substrate by a screen printing method. A glass lid was put so as to cover the printed film, and the temperature was increased in a nitrogen atmosphere at a rate of 100° C./min, followed by heating at 200° C. for one hour. The thickness of a film thus obtained was 10 μm, and the resistivity was 37 μΩcm. The X-ray diffraction pattern of the obtained film was measured, whereupon diffraction peaks derived from metallic copper were confirmed as shown in FIG. 10

Example 73

The same operation as in Example 72 was carried out except that the heating was carried out at 180° C. The thickness of a film obtained was 11 μm, and the resistivity was 39 μΩcm.

Example 74

The same operation as in Example 72 was carried out except that the heating was carried out at 150° C. The thickness of a film obtained was 10 μm, and the resistivity was 52 μΩcm.

Example 75

The same operation as in Example 72 was carried out except that the amount of the solution was changed from 0.092 g to 0.137 g. The thickness of a film obtained was 9 μm, and the resistivity was 59 μΩcm.

Example 76

The same operation as in Example 72 was carried out except that the amount of the solution was changed from 0.092 g to 0.075 g. The thickness of a film obtained was 10 μm, and the resistivity was 27 μΩcm.

Example 77

The same operation as in Example 76 was carried out except that the heating was carried out at 150° C. The thickness of a film obtained was 10 μm, and the resistivity was 52 μΩcm.

Example 78

Figure 11:
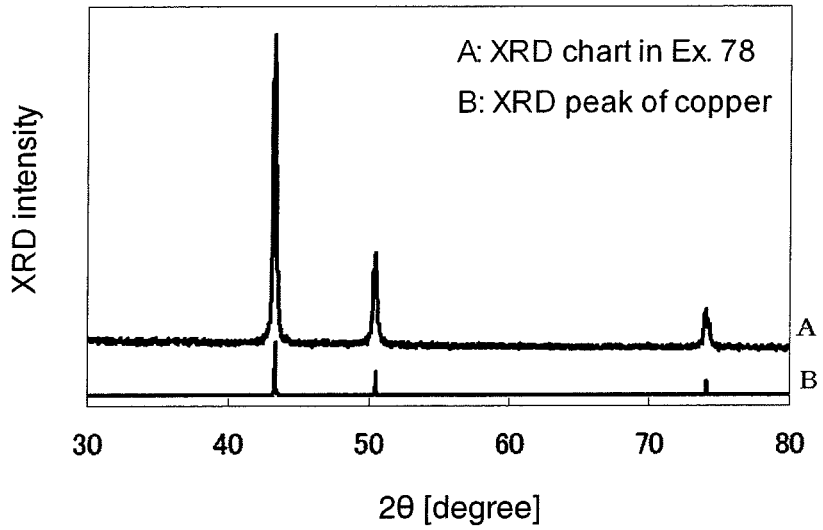
FIG. 11 is a diagram illustrating an X-ray diffraction pattern of a film after heating in Example 78.

A solution having 0.045 g of triruthenium dodecacarbonyl dissolved in 10.0 mL of 2,4-pentanediol was prepared. 0.092 g of this solution, 0.25 g of copper nano particles (manufactured by NISSHIN ENGINEERING INC., average particle size: 100 nm, average surface oxide layer: 10 nm (as observed and measured by TEM)) and 0.043 g of an epoxy resin (manufactured by Toagosei Co., Ltd., grade: BX-60BA) were mixed, followed by printing on a polyimide substrate by a screen printing method. A glass lid was put so as to cover the printed film, and the temperature was increased in a nitrogen atmosphere at a rate of 100° C./min, followed by heating at 200° C. for one hour. The thickness of a film thus obtained was 10 μm, and the resistivity was 31 μΩcm. The X-ray diffraction pattern of the obtained film was measured, whereupon diffraction peaks derived from metallic copper were confirmed as shown in FIG. 11.

Example 79

Figure 12:
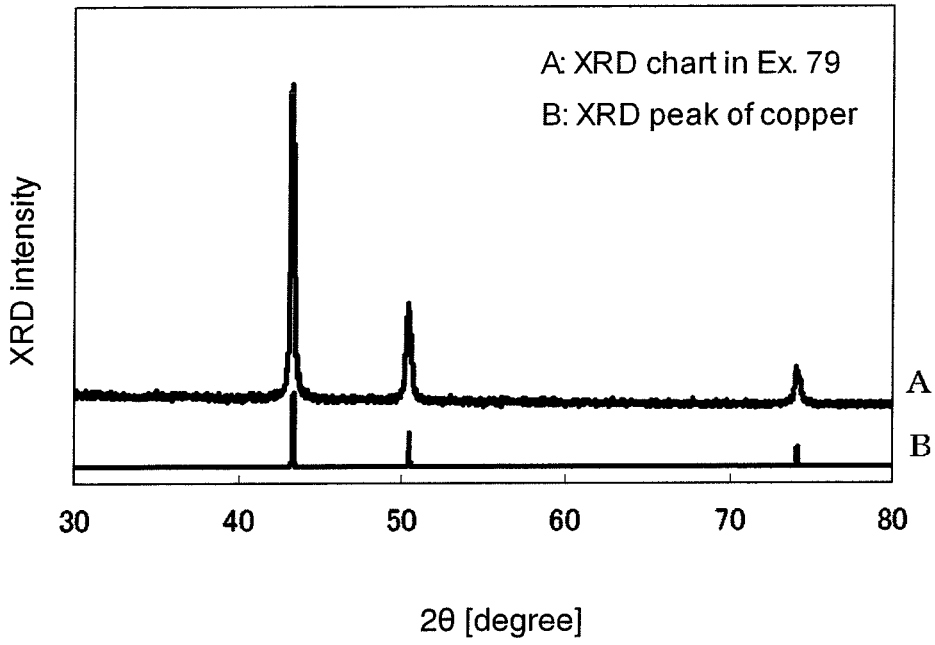
FIG. 12 is a diagram illustrating an X-ray diffraction pattern of a film after heating in Example 79.

The same operation as in Example 72 was carried out except that 0.008 g of a rheology modifier (manufactured by Lubrizol Japan Limited, grade: S-36000) was added. The thickness of a film obtained was 12 μm, and the resistivity was 86 μΩcm. The X-ray diffraction pattern of the obtained film was measured, whereupon diffraction peaks derived from metallic copper were confirmed as shown in FIG. 12.

Example 80

Figure 13:
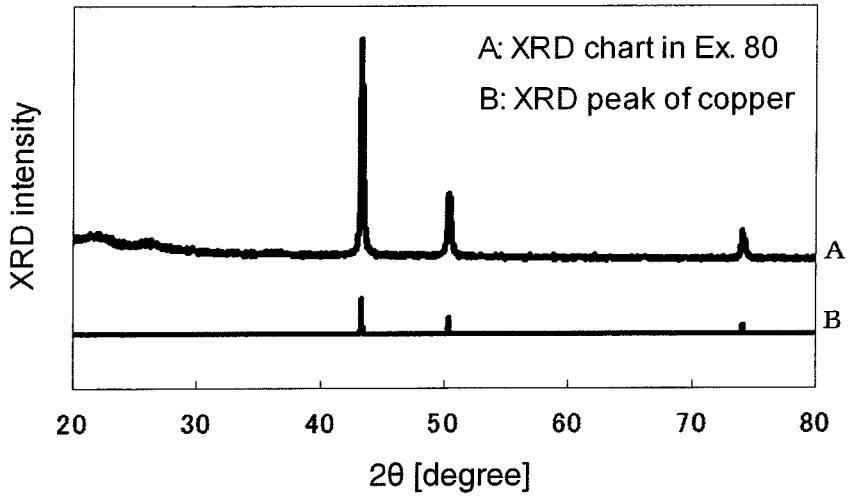
FIG. 13 is a diagram illustrating an X-ray diffraction pattern of a film after heating in Example 80.

A solution (A) having 0.09 g of triruthenium dodecacarbonyl dissolved in 20.0 mL of 1,3-butanediol was prepared. Further, a solution (B) having 0.5 g of copper(I) 1-butanethiolate dissolved in 3.0 mL of 1,3-butanediol was prepared. 0.066 g of this solution (A), 0.01 g of the solution (B), 0.25 g of copper nano particles (manufactured by NISSHIN ENGINEERING INC., average particle size: 100 nm, average surface oxide layer: 10 nm (as observed and measured by TEM)) and 0.043 g of an epoxy resin (manufactured by Toagosei Co., Ltd., grade: BX-60BA) were mixed, followed by printing on a polyimide substrate by a screen printing method. A glass lid was put so as to cover the printed film, and the temperature was increased in a nitrogen atmosphere at a rate of 100° C./min, followed by heating at 200° C. for one hour. The thickness of a film thus obtained was 8 μm, and the resistivity was 20 μΩcm. The X-ray diffraction pattern of the obtained film was measured, whereupon diffraction peaks derived from metallic copper were confirmed as shown in FIG. 13.

Example 81

The same operation as in Example 80 was carried out except that the heating was carried out at 180° C. The thickness of a film obtained was 13 μm, and the resistivity was 32 μΩcm.

Example 82

The same operation as in Example 80 was carried out except that the heating was carried out at 150° C. The thickness of a film obtained was 15 μm, and the resistivity was 53 μΩcm.

Example 83

The same operation as in Example 80 was carried out except that the amount of the solution (A) was changed from 0.066 g to 0.092 g. The thickness of a film obtained was 9 μm, and the resistivity was 29 μΩcm.

Example 84

The same operation as in Example 83 was carried out except that the amount of the solution (B) was changed from 0.01 g to 0.02 g. The thickness of a film obtained was 13 μm, and the resistivity was 68 μΩcm.

Example 85

The same operation as in Example 83 was carried out except that 1,3-butanediol in the solution (A) was changed to 2,4-pentanediol. The thickness of a film obtained was 10 μm, and the resistivity was 22 μΩcm.

Example 86

The same operation as in Example 80 was carried out except that in the solution (B), 0.5 g of copper(I) 1-butanethiolate was changed to 0.3 g of copper(I) hexafluoropentanedionate cyclooctadiene, and the amount of 1,3-butanediol was changed to 2.7 mL. The thickness of a film obtained was 10 μm, and the resistivity was 22 μΩcm.

INDUSTRIAL APPLICABILITY

By using the composition for production of a metal film of the present invention, it is possible to produce a metal film and a metal powder of copper, silver or indium more economically and efficiently, and obtainable metal film and metal powder are useful for a conductive film, a conductive pattern film, a conductive adhesive, etc.

The invention claimed is:

1. A method for producing a copper metal film, the method comprising:

forming a coating film of a composition on a substrate, the composition comprising:

a high-valent compound of copper selected from the group consisting of copper(I) oxide, and copper(I) nitride;

glycerin; and dichlorotris(triphenylphosphine) ruthenium, triruthenium dodecacarbonyl, dihydrido (dinitrogen) tris (triphenylphosphine) ruthenium, or dichloro(ethylenediamine) bis (tri-p-tolylphosphine) ruthenium;

and heating the substrate coated with the coating film to reduce the high-valent compound.

* * * * *